United States Patent [19]

Kerr et al.

[11] 4,021,814

[45] May 3, 1977

[54] BROADBAND CORRUGATED HORN WITH DOUBLE-RIDGED CIRCULAR WAVEGUIDE

[75] Inventors: John L. Kerr, Neptune; Michael J. Timochko, Lanoka Harbor, both of N.J.

[73] Assignee: The United States of America as represented by the Secretary of the Army, Washington, D.C.

[22] Filed: Jan. 19, 1976

[21] Appl. No.: 650,324

[52] U.S. Cl. ..... 343/786
[51] Int. Cl.[2] ..... H01Q 13/02
[58] Field of Search ..... 343/786, 783, 840

[56] References Cited

UNITED STATES PATENTS

| | | | |
|---|---|---|---|
| 3,274,603 | 9/1966 | Kay | 343/786 |
| 3,566,309 | 2/1971 | Ajioka | 343/786 |
| 3,631,502 | 12/1971 | Peters et al. | 343/786 |

*Primary Examiner*—Eli Lieberman
*Attorney, Agent, or Firm*—Nathan Edelberg; Sheldon Kanars; Daniel D. Sharp

[57] ABSTRACT

A broad band corrugated horn antenna with a double-ridged circular waveguide feed is disclosed in which the horn is driven by the wide band signal source having a bandwidth greater than 2:1. The bandwidth is accomplished by providing a ridge pattern with gaps therebetween in which the width of the gaps is greater than the width of the ridges.

1 Claim, 2 Drawing Figures

BROADBAND CORRUGATED HORN WITH DOUBLE-RIDGED CIRCULAR WAVEGUIDE

FIELD OF THE INVENTION

This invention relates to corrugated horn antennas and particularly to broad band corrugated horn antennas.

BACKGROUND OF THE INVENTION

Corrugated horn antennas were developed to provide circularly symmetrical patterns which are virtually free of primary sidelobes. These antennas have been quite successful but have been limited in bandwidth to approximately 2:1.

In the January 1973 edition of "Microwaves" and article appears on pages 44–49 entitled "Corrugations Lock Horns With Poor Beamshapes" in which it is taught that to design a corrugated horn the slot depth sould be greater than a quarter of a wavelength at the low end of the frequency band and less than a half wavelength at the high end. This constraint common to all prior corrugated horn antennas limits the bandwidth thereof to less than 2:1.

The above referred to article also teaches that the slot width should be about a tenth of a wavelength at the low end of the frequency band and the spacing between the slots should be a quarter wavelength at the high end of the band. This will result in a corrugation pattern with the slots being less than a half of the available material.

Because of the above constraints, corrugated horn antennas have not been available to obtain a circularly symmetrical pattern where a constant beamwidth is required over a band width of greater than 2:1.

BRIEF DESCRIPTION OF THE INVENTION

In order to overcome the problems of the prior art, a microwave corrugated horn antenna is provided which includes a plurality of ridges each having a predetermined width and a plurality of gaps between the ridges, each having a predetermined width. The microwave corrugated horn antenna is characterized in that the width of gaps is greater than the widths of the ridges.

In the preferred embodiment of this invention, the microwave corrugated horn antenna is driven by a wide band signal source having a bandwidth of greater than 2:1 through a ridged circular waveguide.

Therefore, a greater than 2:1 bandwidth is obtained by merely changing the relative dimension of the ridges and gaps and without introducing any lossy materials such as resistive type mode suppressors or the like.

DESCRIPTION OF THE DRAWINGS

For more complete understanding of the invention, reference should be made to the following detailed description and the drawings in which.

DETAILED DESCRIPTION OF THE INVENTION

Figure 1:
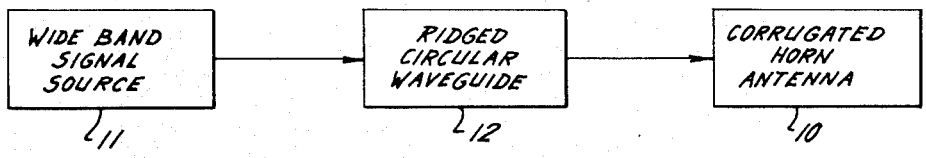
FIG. 1 is a block diagram showing a system including a corrugated horn in accordance with the teachings of this invention.

Referring now to FIG. 1, we see a corrugated horn antenna 10 driven by a wide band signal source 11 through a ridged circular waveguide 12.

Figure 2:
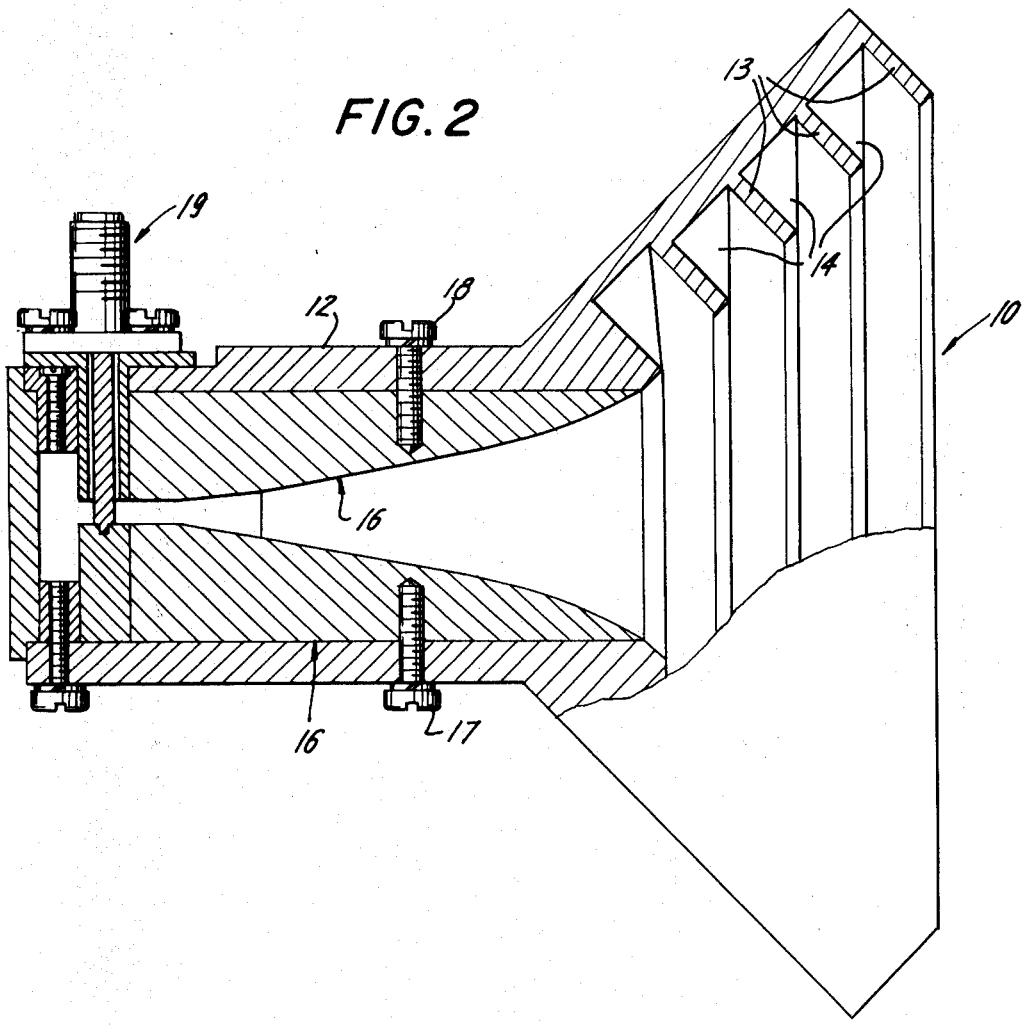
FIG. 2 is a sectional view showing the corrugated horn of this invention.

In FIG. 2 we see the details of the ridged circular waveguide 12 and the corrugated horn 10. The corrugated horn antenna 10 has a plurality of ridges 13 each having a predetermined width with a plurality of gaps 14 separating the ridges 13. In accordance with this invention, it has been found that by making the gaps 14 wider than had been made in the past and the ridges 13 narrower than had been employed in the past, a bandwidth greater than 2:1 can be achieved notwithstanding the fact that the prior art has taught that a 2:1 bandwidth is the limit of usefulness of a corrugated horn antenna. It is also noted that the depths of the gaps are less than a quarter wavelength at the low end of the band rather than greater than ¼λ as required by prior theory.

In order to properly drive the corrugated horn antenna, the ridged circular waveguide 12 is employed. In the preferred embodiment of the invention, two ridges 16 are mounted in the circular waveguide by holding screws 17 and 18.

A connector 19 is employed to connect the wide band source 11 to drive the ridged circular wavelength 12.

An antenna was designed using the above principles for use in a direction finding system. The antenna design operated over the 8.5 to 18 GHz frequency range with a relatively constant half power beamwidth in the order of 30°–45°. The antenna responded equally in both horizontal and vertical polarizations.

The final design of the horn was a four cell (gap) design with a 45° half angle. The three cells closest to the periphery of the horn had a depth of 0.300 inches while the cell closest to the circular waveguide had a depth of 0.320 inches. Each of the cells had a gap width of 0.250 inches while the ridge width was 0.050 inches.

While this invention has been described with respect to a particular embodiment thereof, numerous others will become obvious to those of ordinary skill in the art in light thereof.

What is claimed is:

1. A microwave corrugated horn antenna for operating over a frequency bandwidth greater than two to one comprising a plurality of ridges each having a predetermined width and a plurality of gaps of predetermined width disposed therebetween, the width of said gaps exceeding the width of said ridges and the width of each said gap being substantially 0.38λ where λ is the wavelength at the upper end of the frequency band of operation and the depth of said gaps being less than one quarter wavelength at the lower end of the operating frequency band.

* * * * *